US005351346A

United States Patent [19]

Hodges, Jr.

[11] Patent Number: 5,351,346

[45] Date of Patent: Oct. 4, 1994

[54] DEVICE FOR HOLDING SHOWER ARTICLES

[76] Inventor: James E. Hodges, Jr., 888 Congdon Ave., Apt. 23, Bldg. B, Elgin, Ill. 60120

[21] Appl. No.: 97,404

[22] Filed: Jul. 26, 1993

[51] Int. Cl.[5] ..... A47K 5/00

[52] U.S. Cl. ..... 4/605; 4/661; 24/3 M; 224/220; 211/113

[58] Field of Search ..... 211/113; 4/605, 661; 224/197, 202, 220, 232, 254; 132/146, 259, 290; 24/3 M; 294/159, 160, 161, 162; 150/160

[56] References Cited

U.S. PATENT DOCUMENTS

| | | | |
|---|---|---|---|
| 452,830 | 5/1891 | Bowie et al. | 224/220 |
| 534,946 | 2/1895 | Bates | 224/220 |
| 815,277 | 3/1906 | Facette | 224/202 |
| 1,498,247 | 6/1924 | Stewart | 294/160 |
| 2,432,957 | 12/1947 | Webster | 211/113 |
| 2,487,339 | 11/1949 | Kindlund et al. | 24/3 M |
| 3,188,130 | 6/1965 | Pietrowicz | 224/921 |
| 3,212,679 | 10/1965 | Schmidt, Jr. | 224/220 |
| 3,387,752 | 6/1968 | Martin et al. | 294/159 |
| 3,460,207 | 8/1969 | Stewart | 150/160 |
| 3,833,159 | 9/1974 | Ono | 211/113 |
| 4,108,314 | 8/1978 | Racca | 211/113 |
| 4,181,234 | 1/1980 | Feighan | 211/113 |
| 4,361,934 | 12/1982 | Darnell | 24/3 M |
| 4,998,647 | 3/1991 | Sharp | 211/113 |

FOREIGN PATENT DOCUMENTS

| | | | |
|---|---|---|---|
| 26400 | 7/1909 | United Kingdom | 224/220 |

*Primary Examiner*—Henry J. Recla
*Assistant Examiner*—Gregory M. Vidovich
*Attorney, Agent, or Firm*—Bullwinkel Partners, Ltd.

[57] ABSTRACT

A lightweight, flexible device for holding shower articles such as shampoo, soap, or lotion comprising a loop for suspending the device from a shower head, a plurality of ropes connected to the loop, and hooks for holding the shower articles to the ends of the ropes opposite the suspending loop. Preferably, the loop is formed of rubber or plastic which will grip the neck pipe of a shower head. The device may be used at home or packs easily for travelling.

3 Claims, 1 Drawing Sheet

DEVICE FOR HOLDING SHOWER ARTICLES

BACKGROUND

1. Field Of The Invention

This patent relates to shower accessories. More particularly, this patent relates to a device for holding shower articles, such as shampoo, soap, razors, and the like.

2. Description Of The Related Art

Racks or trays for holding shower articles are well known in the art. Typically, such racks or trays are suspended from the neck pipe of the shower head so as to place the shower articles within easy reach of the user. One type of shower rack, disclosed in U.S. Pat. No. 5,180,067, comprises a wire frame and a plastic tray carried by the wire frame and configured to hold soap, toothbrushes and other shower articles. U.S. Pat. No. 4,541,131 describes a combination bath and shower accessory comprising a rectangular frame with object storing trays slidably and rotatably mounted between spans of the frame, the frame being adaptable to function either as a bath or shower accessory.

These and other shower accessories known in the art share the disadvantage of being rigid, relatively bulky and, therefore, not easily transportable. They also have a tendency to slip down the neck pipe of the shower head, which can be both inconvenient and annoying.

It can also be difficult to extract the liquid contents from bottles which have been resting in trays or on wire racks with their cap ends up. This is particularly true when the bottles are almost empty. When the bottles are full, conventional wire racks and trays tend to tilt if not properly balanced, causing the bottles to tip over and sometimes spill their contents.

SUMMARY OF THE INVENTION

It is thus an object of the present invention to provide a device to hold shower articles such as shampoo, soap, lotions and the like which is lightweight and flexible and can be easily transported for use at home or while travelling.

It is another object of the present invention to provide a means for holding shower articles which can be suspended securely from the neck pipe of a shower head without slipping.

A further object of the present invention is to provide a device which holds tubes or bottles containing liquids in a bottoms up position, thus making it easier to extract the contents from the bottle or tube.

A still further object of the present invention is to provide a device for holding shower articles which eliminates tipping and spilling of bottles.

Further and additional objects will appear from the description, accompanying drawings, and appended claims.

The present invention is a device for holding shower articles comprising means for suspending the device from a shower head, a plurality of ropes connected to the suspending means, and fastening means for holding the shower articles to the ends of the ropes opposite the retaining means. The suspending means may be a loop of rubber or plastic or other suitable material which will grip the neck pipe of a shower head. The fastening means may be hooks or other fasteners suitable for detachably retaining bottles or tubes of shampoo, soap, lotion, etc.; a razor; or other shower articles.

THE DRAWINGS

DETAILED DESCRIPTION OF THE INVENTION

Figure 1:
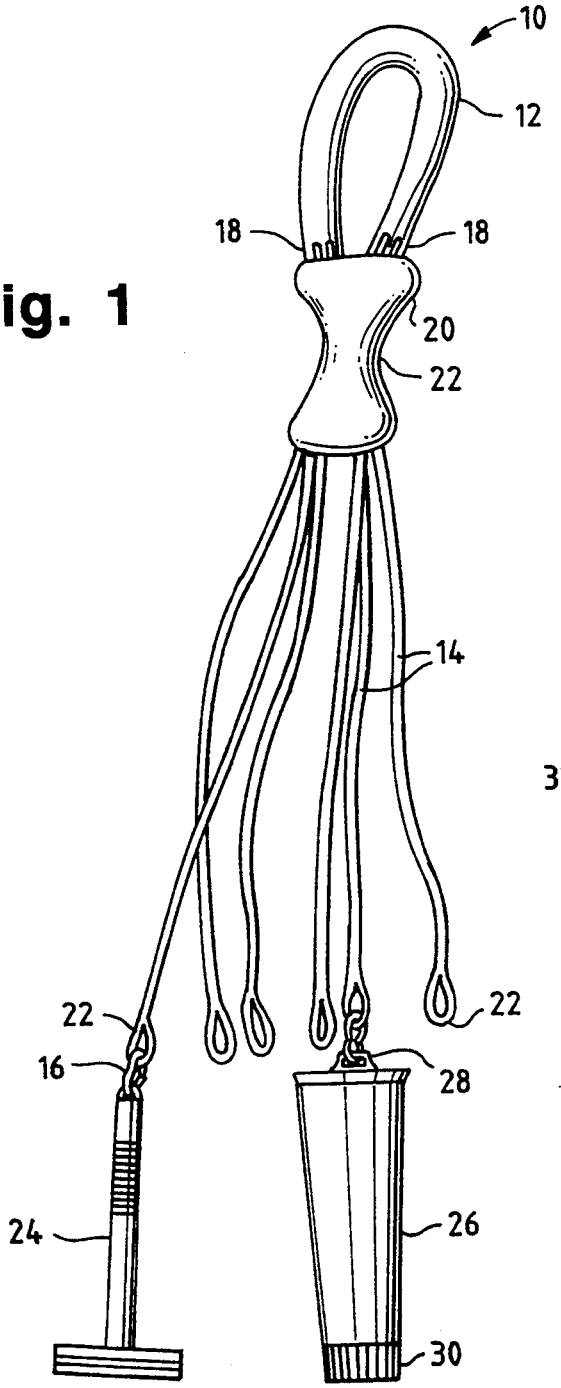
FIG. 1 is a perspective view of the preferred embodiment of the present invention.

Turning to the drawings, there is shown in FIG. 1 one embodiment of a shower accessory 10 according to the present invention comprising a rubber or plastic loop 12 for suspending the shower accessory 10 from the neck pipe of a shower head, ropes or lines 14 extending from the suspending means, and hooks 16 for fastening shower articles to the ropes 14.

The loop 12 and the ropes 14 may be constructed from the same piece of material. In the preferred embodiment, the loop 12 is a large diameter rubber rope which separates at either end 18 into five or six smaller diameter ropes 14, although a different number of ropes may be used in practice.

The large diameter loop 12 can be made of rubber, plastic, or other waterproof material that will grip the neck pipe of the shower head to prevent slipping. To further prevent slipping, the ends 18 of the large diameter loop 12 extend through a slip knot 20 which can be drawn toward the large diameter loop 12 to snug up the loop 12 against the neck pipe of the shower head. The slip knot 20 may be pinched in the middle 22 to provide a friction grip on the loop 12 and ropes 14.

Figure 2:
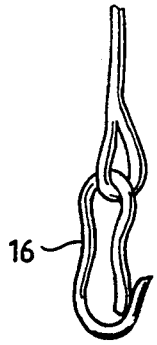
FIG. 2 is an enlarged view of the fastening means shown in FIG. 1.

In the preferred embodiment, the ropes 14 extend about fourteen inches below the slip knot 20, although this length may be varied as desired. The ends of the ropes 14 opposite the large diameter loop 12 terminate in small loops 22 to accommodate the hooks 16. As best shown in FIG. 2, the hooks 16 are of the type having a resistance type closure which can be manipulated by hand for easy opening or closing. The hooks 16, like the rest of the shower accessory 10, are made of plastic or other suitable waterproof material.

Shower articles are hung from the hooks for easy access by the user. Shower articles may include tubes or bottles of shampoo, lotion, conditioner, shower gel, facial soap, toner, after shave splash, after shower splash, or facial scrub. A shaver 24 may also be hung from one of the hooks 16, as shown in FIG. 1. In practice, specially designed tubes or bottles 26 having a loop 28 extending from the end of the tube or bottle opposite the cap 30 may be used to contain the shampoo, soap, etc.

Figure 3:
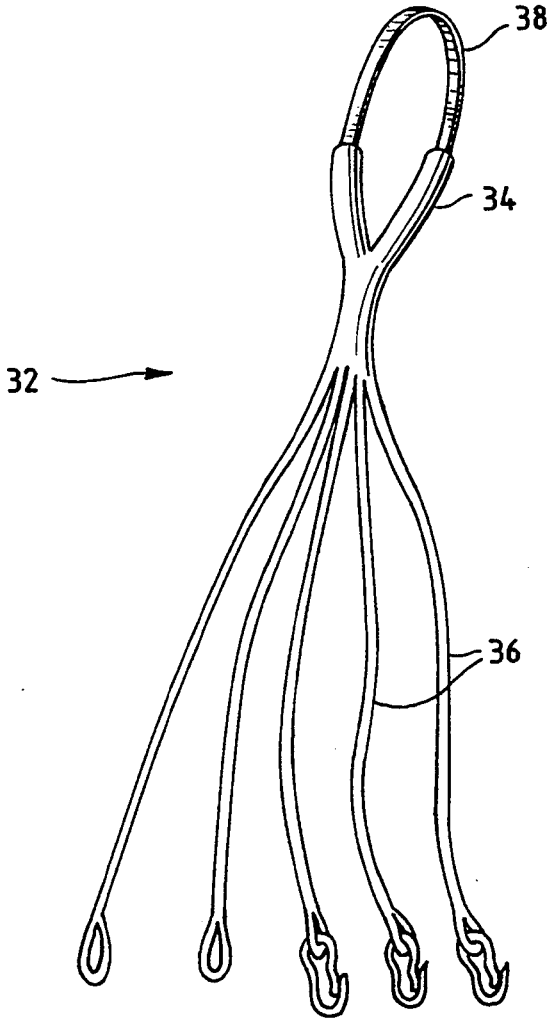
FIG. 3 is a perspective view of an alternative embodiment of the present invention.

An alternative embodiment of the shower accessory is shown in FIG. 3, wherein the shower accessory 32 comprises an O-shaped portion 34 and a plurality of ropes 36 extending from the O-shaped portion 34, but no slip knot. The O-shaped portion 34 is configured to hang from the neck pipe of a shower head, and has a flat rubber portion 38 for gripping the neck pipe to prevent slipping. The O-shaped portion 34 should be large enough to fit over most shower heads.

Thus it is evident that the present invention provides a lightweight, flexible device to hold shower articles such as shampoo, soap, lotions and the like which can be easily transported for use at home or while travelling. The present invention can be suspended securely from the neck pipe of a shower head without slipping. In addition, the present invention holds bottles containing liquids in a bottoms up position, thus making it easier to extract the contents from the bottle.

Other modifications and alternative embodiments of the invention are contemplated which do not depart from the spirit and scope of the invention as defined by the foregoing teachings and appended claims. For example, instead of using hooks from which to hang the tubes and bottles, alligator type clamps may be substituted.

I claim:

1. A device for holding shower articles comprising:

a single, flexible member having first and second ends and a mid-section intermediate said first and second ends, said member further including a first plurality of strands having respective first ends extending from said first end of said member and said first plurality of strands having respective second ends, said member further including a second plurality of strands having respective first ends extending from said second end of said member and said second plurality of strands having respective second ends, said second ends of said first and second plurality of strands each including fastening means for holding at least one shower article, said device further including a slip sleeve slidably mounted to said first and second plurality of strands, said slip sleeve having a narrowed central section through which all of said first and second plurality of strands extend and providing a fraction fit therewith, whereby said slip sleeve, said first and second ends of said member and said mid-section of said member define a loop for suspending the device from a neck pipe of a shower head and said slip sleeve provides a means for tightening the device about the neck pipe of the shower head.

2. The device of claim 1 further including at least one shower article held by said fastening means, wherein said at least one shower article is a container adapted to be detachably connected to one of said fastening means.

3. The device of claim 1 in which said fastening means includes hooks and further including at least one shower article adapted to be held by said hooks, wherein said at least one shower article is a container adapted to be detachably connected to one of said hooks having a resealable end with a cap and an end opposite the resealable end wherein said end opposite the resealable end includes a fastening loop extending therefrom, wherein said fastening loop is sized to allow said hooks to extend therethrough.

* * * * *